United States Patent [19]

Chitwood et al.

[11] 4,200,131

[45] Apr. 29, 1980

[54] DEVICE FOR CARRYING GOLF CLUBS

[76] Inventors: Ernest L. Chitwood, 2827 Olive Ave.; Max E. Jones, 42398 Barbary St., both of Fremont, Calif. 94538

[21] Appl. No.: 769,512

[22] Filed: Feb. 17, 1977

Related U.S. Application Data

[63] Continuation-in-part of Ser. No. 667,360, Mar. 15, 1976, abandoned.

[51] Int. Cl.[2] ..... A63B 55/00

[52] U.S. Cl. ..... 150/1.5 R; 211/60 G

[58] Field of Search ..... 224/45 R, 29 B, 274; 150/1.5 R, 1.5 B, 1.5 C; 211/60 G; 248/95, 96; 280/47.19, DIG. 6

[56] References Cited

U.S. PATENT DOCUMENTS

| | | | |
|---|---|---|---|
| 2,436,687 | 2/1948 | Corbett | 150/1.5 |
| 2,662,776 | 12/1953 | Hurst | 280/DIG. 6 |
| 2,685,317 | 8/1954 | Lace et al. | 150/1.5 R |
| 2,763,309 | 9/1956 | Jones | 150/1.5 R |
| 2,879,819 | 3/1959 | Turnbull | 150/1.5 R |
| 3,164,393 | 1/1965 | Upham | 280/47.19 |
| 3,460,597 | 8/1969 | Daly | 150/1.5 C |
| 3,534,795 | 10/1970 | Wiedenmeier | 150/1.5 R |
| 3,664,399 | 5/1972 | Neff | 150/1.5 R |

FOREIGN PATENT DOCUMENTS

| | | | |
|---|---|---|---|
| 2220493 | 2/1973 | Fed. Rep. of Germany | 150/1.5 C |
| 345825 | 4/1931 | United Kingdom | 150/1.5 R |
| 743892 | 1/1956 | United Kingdom | 280/DIG. 6 |

*Primary Examiner*—Joseph F. Peters, Jr.
*Assistant Examiner*—D. W. Underwood
*Attorney, Agent, or Firm*—Warren, Chickering & Grunewald

[57] ABSTRACT

There is disclosed a device for carrying golf clubs which includes a molded upper plate having individual holes for the handles and shafts of the clubs to be carried and having contoured surfaces coinciding with the loft angle of golf club irons so that each iron is maintained with its striking face in contact with a mating surface while it is being transported in the device, and with each contoured surface being longer than the corresponding surface of the golf club whereby, when the device is oriented with the gold clubs vertical, the contoured surfaces extend to a higher elevation than any portion of the heads of the golf clubs.

10 Claims, 7 Drawing Figures

DEVICE FOR CARRYING GOLF CLUBS

CROSS REFERENCE

This is a continuation-in-part of my copending patent application Ser. No. 667,360 filed Mar. 15, 1976 for DEVICE FOR CARRYING GOLF CLUBS now abandoned.

BACKGROUND OF THE INVENTION

Golf bags and other devices for carrying golf clubs are available in many designs which range from simple cylindrical tubes to complicated devices having individual receptacles for each club and wheels for rolling the clubs during transporting them rather than carrying them. Devices for carrying golf clubs should satisfy many criteria to be most useful.

In addition to simply holding the clubs and providing a means for transporting them, devices for carrying golf clubs should hold the clubs in an array so that selection of individual clubs is easy, and it is not necessary to sort through all of the clubs in the device to find the one that is desired. In the past some separation of clubs has been made by placing dividers in the upper opening of the bag so that three layers of clubs can be formed. Usually the upper layer is for the golf clubs known as woods, the middle layer contains the golf clubs known as long irons, and the lower layer contains the golf clubs known as short irons. Although arranging golf clubs in three groups greatly relieves the problem, some sorting through of the clubs is still required to find the one that is desired.

Devices for carrying golf clubs should protect the clubs by having means to prevent them from banging together and to avoid erosion of the grips of the golf clubs when individual clubs are slid into and out of the golf club carrying device while others remain within the device. Protecting the grips of golf clubs has been accomplished by using individual plastic tubes within a golf bag or by having separate pockets in which to carry each club, but banging together of the club heads remains a problem. Although irons are not marred as readily as woods, the banging together of iron clubs does mar the finish. Transporting golf clubs when they are in use, as when being transported around a golf course, presents problems in erosion and rough contact between the clubs. However, transporting golf clubs as airline luggage produces severe problems in destruction in that such baggage is handled roughly and is frequently not oriented with vertical as it would be when in use on a golf course. When golf club carrying devices are employed as luggage for carrying golf clubs from one point to another as in airline baggage, it is also a problem to maintain the clubs within the carrying device if the carrying device is turned upside down with respect to its normal orientation. The problem of transporting golf clubs is normally solved by having an auxiliary bag that fits over the top of the clubs and is connected to the main bag with snap fasteners or the like. This means of maintaining all of the clubs together is so notoriously unsatisfactory, however, that airlines frequently require the auxiliary bag to be taped securely to the main bag to prevent separation of the two.

Golf club carrying devices should be lightweight so that they can be moved readily and carried long distances, they should be comfortable to carry or to roll, and they should have general convenience items associated with them, such as compartments or pockets for storage of balls, tees, rain gear and the like.

THE INVENTION

This invention is a device for carrying and transporting golf clubs that provides exceptional protection for the golf clubs and maintains them organized for easy use on a golf course. The device of this invention includes an upper plate having an upper face through which a plurality of holes passes. At least some of the holes are adapted to receive golf club irons, and these holes have adjacent to them a club face receiving surface which is at an angle to the upper face of the plate which corresponds to the loft angle of a particular golf club iron. For example, the hole that is provided in the upper plate to receive the putter will have a surface associated with it that is about perpendicular to the upper face of the plate. This surface is adjacent to the hole and oriented so that in normal use the face of the putter will lie against the surface. The hole to receive a wedge will have an adjacent surface at a very steep angle with respect to the upper face of the plate. Each of the surfaces associated with the hole is oriented to extend away from the hole in the same direction as the other surfaces so that the intersections of these surfaces with the plane of the upper face are parallel lines. Each of the holes is sufficiently large to receive the grip and the shaft of the club.

The club face receiving surfaces are wider than the club faces they correspond to. Thus, the width of each club face receiving surface is greater than the distance from the base to the top of the blade of the club it is adapted to receive. With this construction, when the device of this invention is vertically oriented, the club heads will all be in contact with the receiving surfaces but below an imaginary line intersecting the upper extremity of each surface. As will be described in more detail hereinafter, this construction completely protects each club that is in contact with its receiving surface from being contacted by any other club that is being taken from or replaced in the carrying device.

The device of this invention also includes at least one compartment beneath the plate to receive the shafts of the clubs. The compartment is at least as long as the distance from the club head to the end of grip so that when the device of this invention is vertical with the plate at the highest elevation, the irons hang from the upper face of the plate. Preferably, each of the holes is provided with its own tube so that each club shaft has its own compartment.

The device of this invention also includes a frame to hold the plate, the compartments and various means for carrying or rolling the device of this invention in the proper orientation with respect to each other. If the compartments are a number of tubes of metal or strong plastic, the tubes themselves may be the frame. However, a separate frame to support the various elements relative to each other preferably is used.

The plate also, preferably, contains holes to receive golf club woods with separate compartments below each hole to receive the shaft of the woods. The holes to receive the woods do not have surfaces adjacent to them which mate with the loft angles of the woods. The compartments to receive the shafts of the woods also do not have to be as long as the distance between the end of the grip and the club head of the wood. Preferably, the holes to receive the woods are spaced far enough apart to avoid contact of the wood heads with each other, thereby avoiding the need for protective mittens to prevent marring the wood club heads.

The device of this invention may have other features, such as compartments for holding balls, tees, jackets, etc. or a receptacle for score cards, pencils, etc.

A particularly desirable feature of the present invention is the ease with which it can be used to transport clubs as ordinary luggage, for example, as airline baggage. With the club heads in contact with the upper plate and held against a mating surface, a flat leather or plastic cover can be used and held tightly as with belts in contact with the upper extremities of the club head receiving surfaces. The club heads thus held are held within individual compartments so they cannot bang against one another, nor could they come out of the carrying device even if it were turned upside down. Transporting golf clubs in this manner avoids marring of the club heads and prevents clubs from falling from the carrying device even if it is turned upside down.

The club face receiving surfaces preferably are integral with the plate and formed with the plate by a molding process so that the plate and surfaces are all one piece. The surfaces may extend from the upper face of the plate or may be recessed into the plate, as will be described in more detail hereinafter. The device of this invention also includes a carrying means which may be a conventional strap for hanging the device from the shoulder, or it may be an axle and wheels connected to the frame with a handle for pulling the device. Whatever carrying means is employed, it is oriented on the device so that in the ordinary mode of transportation the club face receiving surface associated with a hole will be lower in elevation than the hole. It is also preferred that the club head receiving surface be at an angle so that it lies in no vertical plane and pitched so that gravity will hold the striking surface of the golf club iron against the surface on the plate that is associated with the hole in which the shaft of that golf club is placed.

It is also desirable to arrange the holes and surfaces in tiers so that the club numbers associated with various holes are consecutive and so that the higher club numbers, such as the six iron through the nine iron, will be in the lowest tier in the normal manner of carrying the clubs. Indicia indicating which club goes in each hole may be molded into the surface of the plate or applied thereafter with paint or the like.

DETAILED DESCRIPTION OF THE INVENTION

The present invention may be best described with reference to the accompanying drawings which illustrate various embodiments thereof.

Figure 1:
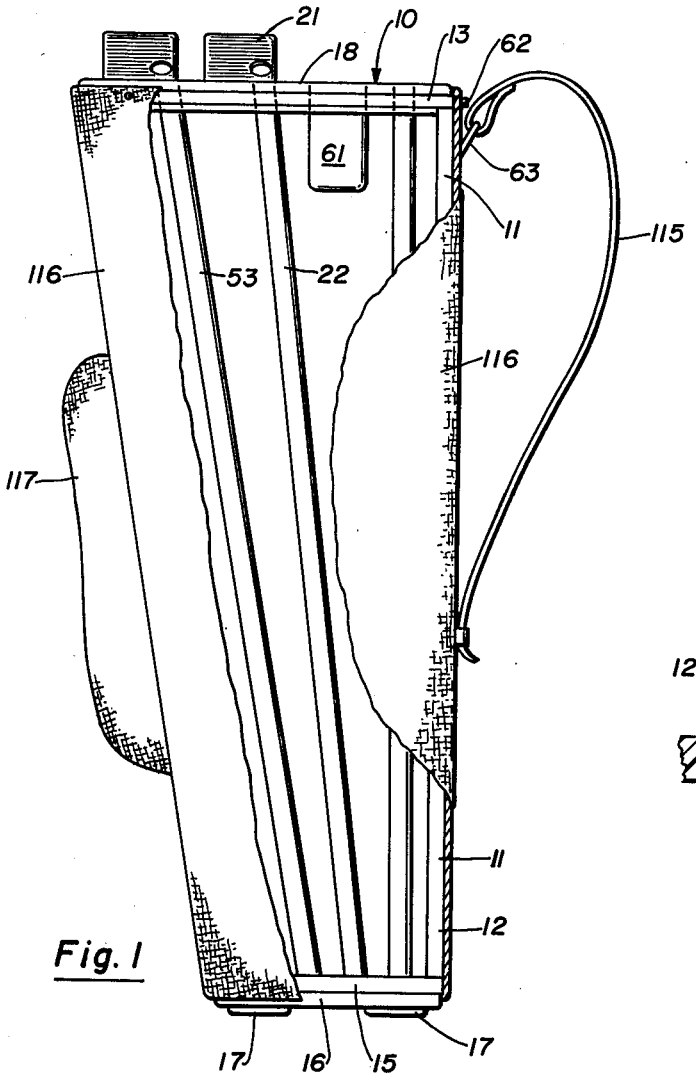
FIG. 1 is an elevation view of a device embodying this invention having fabric portions broken away to better illustrate the details of construction.
Figure 3:
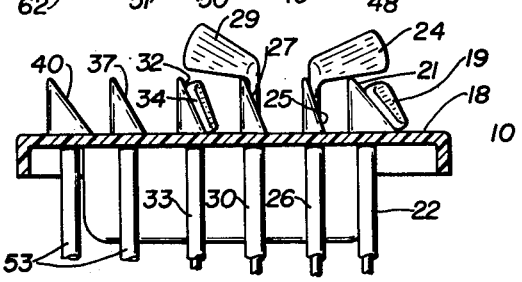
FIG. 3 is a partial sectional view of a device embodying this invention taken along the line 3—3 in FIG. 2.
Figure 4:
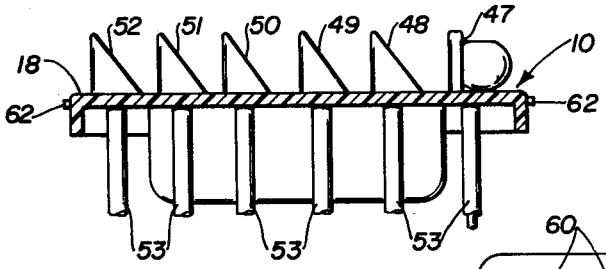
FIG. 4 is a partial view of a device embodying this invention taken along the line 4—4 of FIG. 2.

The device illustrated in FIG. 1 includes an upper plate 10 and a frame 11 that contains a vertically supporting member 12 and an element 13 that holds the upper plate 10, as well as a similar element 15 that holds a lower plate 16 that is provided with feet 17 in the embodiment illustrated. The plate 10 has an upper surface 18 that is provided with a number of holes passing entirely through the plate 10. Each hole is associated with a surface that is contoured to have an angle with respect to the plate 10 that corresponds to the loft angle of a particular golf club iron. Thus, hole 20 is associated with an extension having a surface 21 protruding above the upper surface 18 and having an angle with respect to the plane of surface 18 that corresponds to the loft of a wedge. A wedge 19 positioned in the hole 20 and lying with its striking surface against the surface 21 is best illustrated in FIG. 3. Surface 21 is wider than the striking surface of the wedge and it therefore extends above all portions of the wedge.

The hole 20 is large enough to admit the grip and shaft of the golf club. Beneath the plate 10 and opening to coincide with the hole 20 is a tube 22 which is large enough to enclose the grip and shaft of the golf club. The tube 22 is longer than the distance between the club head and the end of the grip of the golf clubs so that the golf club having its face in contact with the surface 21 and its shaft within the tube 22 will be hanging by the club head. Hole 23 is associated with surface 25 which has an angle with respect to the plane of face 18 that corresponds to the loft angle of a number one iron. A tube 26 extends below the hole 23 in a position appropriate to hold the suspended shaft of a number one iron whose striking face is in contact with surface 25. Similarly, hole 27 is associated with surface 28 and tube 30 to hold a number two iron, while hole 31 is associated with surface 32 and tube 33 to hold a number three iron. A number three iron 34 is illustrated in FIG. 3 in the position it will occupy when being carried in the device of this invention. The shaft 35 of the three iron is shown extending below the cutaway portion of tube 33.

For purposes of illustration, a number one iron 24 is illustrated in a position it might occupy momentarily if it were replaced in the carrying device carelessly in hole 23. It can be seen that the blade of the number one iron 24 cannot contact the blade of the wedge 19, but instead it will strike only the soft plastic extension which includes surface 21. Similarly, a number two iron 29 in hole 27 oriented with its blade over the blade of the number three iron 34 is prevented from striking the number three iron by the extension which includes surface 28.

In similar fashion, hole 36 is associated with surface 37, and hole 38 is associated with surface 40 whereby the four iron and the five iron, respectively, may be received. Surface 37 and surface 40, respectively, are at an angle with upper face 18 that corresponds to the loft angle of a four iron and a five iron respectively.

Holes 41, 42, 43, 44, 45 and 46 are illustrated as being associated with surfaces 47, 48, 49, 50, 51 and 52 which are respectively adapted to receive the striking faces of a putter, six iron, seven iron, eight iron, nine iron, and wedge. Two wedge surfaces are illustrated as a preferred embodiment since many golfers carry both a pitching wedge and a sand wedge which have similar loft angles but differing characteristics to accommodate to hitting a ball lying in grass or hitting a ball lying in sand. Each of the holes 36 through 46, respectively, has a tube 53 associated with it to receive the shaft of the golf club placed in the hole; and in all cases the tubes 53 are long enough to prevent the base of the club shaft from resting on the bottom of the tube. In other words, the golf clubs are suspended by their club heads from the upper face 18 of the plate 10.

The device of this invention may include additional holes 60 to receive golf club woods and other features such as a compartment 61 for miscellaneous equipment such as balls, tees, score cards, pencils, etc. The device may also include fastening means 62 which may be snap fasteners or equivalent means for holding a cover in place over the club heads installed on plate 10: for example, during transportation.

Figure 2:
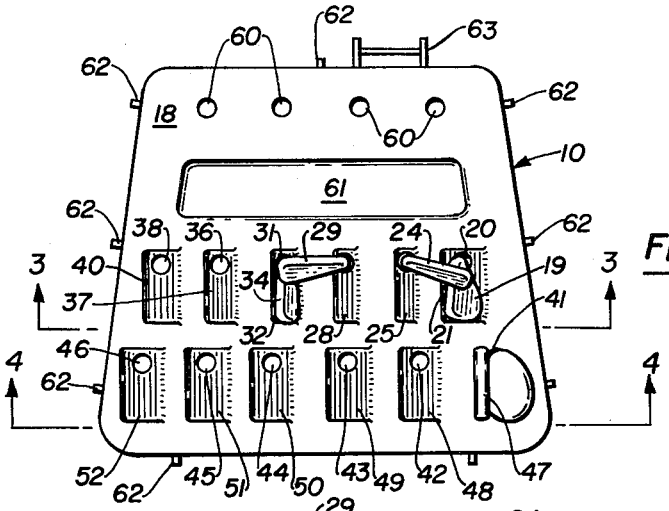
FIG. 2 illustrates a device embodying this invention as viewed from the top.

A means 63 may be provided for attaching a carrying strap to the device of this invention, and as here illustrated the means 63 is off center causing the device to be carried with the surfaces, as viewed in FIG. 2, to be at an angle with vertical so that the striking faces of the golf club heads will be pulled by gravity snugly against the club face receiving surfaces molded onto plate 10.

Figure 5:
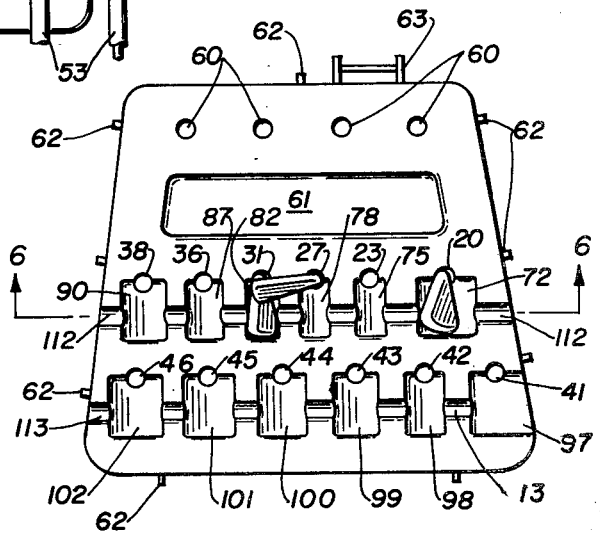
FIG. 5 is a plan view of another device embodying this invention as viewed from above.
Figure 6:
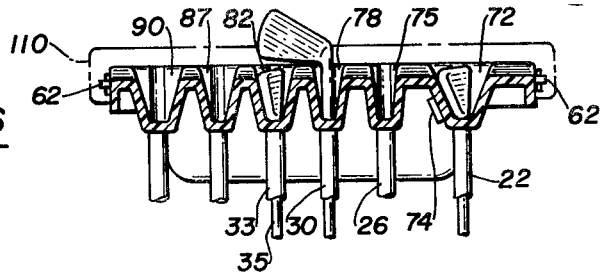
FIG. 6 is a partial sectional view of the device illustrated in FIG. 5 taken along the line 6—6 and shown with a cover suitable for holding golf clubs in place during transportation.

Another device embodying the present invention is illustrated in FIGS. 5 and 6 wherein the golf club receiving surfaces are formed indentations in the plate 10. In this embodiment, the club heads will nest within the indentations and lie flat against the surfaces adapted to receive them. Thus, hole 20 is adapted with an indentation 72 into which the club head of a golf club, illustrated as a wedge 74, may lie. Each indentation is adapted to receive the head of its appropriate club; for example, indentation 75 associated with hole 23 is adapted to receive a one iron, while indentations 78, 82, 87 and 90 are adapted respectively to receive a two iron, a three iron, a four iron, and a five iron. These indentations are, respectively, associated with holes 27, 31, 36 and 38. Similarly, holes 42, 43, 44, 45 and 46 are associated with indentations 98, 99, 100, 101 and 102 to receive, respectively, a six iron, a seven iron, an eight iron, a nine iron, and a wedge. Hole 41 is associated with a very large indentation 97 which intersects the edge of plate 10 to accommodate to the various sizes and shapes of the heads of putters. In all cases the indentations are deeper than the vertical distance between the base and the top of the blade of the club head which it is adapted to receive. FIGS. 5 and 6 illustrate how this construction affords protection to club heads. The three iron resting in indentation 82 is protected from contact with the blade of the two iron which is carelessly being replaced in indentation 75 because indentation 82 is too deep to permit contact.

In one embodiment of the invention the club face may be held against its mating surface with magnets built into the surfaces. For example, a magnet 74 may be positioned with respect to the club head-engaging surface to prevent the clubhead from moving in indentation 72.

The embodiment illustrated in FIGS. 5 and 6 has several advantages. One advantage is that by providing the indentations with converging sides that intersect the upper face 18 at the same angle, the embodiment of FIGS. 5 and 6 can be employed either with left handed clubs or with right handed clubs with equal facility. In addition, as the club head falls into them the diverging sides of the indentations will produce a cam-like action to hold the striking face of the club against its receiving surface in the indentation. Still another advantage of the embodiment illustrated in FIGS. 5 and 6 is that when all clubs are in place in their respective indentation, a flat upper surface is provided that readily accommodates to a cover 110 which holds the clubs in place in their respective indentations without having to be fitted to their particular shapes or without having space for movement available.

In the embodiment illustrated in FIGS. 5 and 6, it is preferable that a groove 112 that is deep enough to give a golfer a finger-hold on a club head be provided to factilitate the ease with which golf clubs may be removed from their respective indentations. A groove 113 is provided to remove golf clubs from indentations 98 through 102 inclusive.

The device of this invention may be employed as a conventional golf bag as illustrated in FIG. 1 wherein it is provided with a carrying strap 115 and covered with fabric, leather, plastic, or the like as illustrated at 116 to provide a conventional appearance. The device may also include zippered compartments as at 117 for carrying extra equipment, and as can be seen from the illustration in FIG. 1, the compartment 117 may extend far within the confines of the covering 116 without interfering with the shafts of the golf clubs which are within tubes 22 and 53, as illustrated in FIG. 1. Although not illustrated, the frame could be provided with wheels and a handle so that the device could be used as a cart rather than as a bag to be carried on the shoulders.

Figure 7:
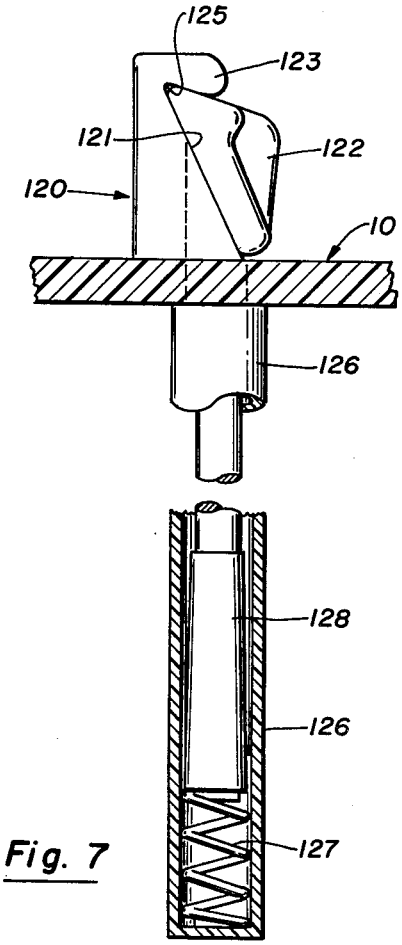
FIG. 7 is a partial sectional view of a single club-holding assembly illustrating another embodiment of this invention.

Another embodiment of the device of this invention is illustrated in FIG. 7. In FIG. 7 the plate 10 is molded with an upwardly extending element 120 which includes a surface 121 at an angle to the upper face of plate 10 that corresponds to the loft angle of a golf club iron illustrated as 122.

The element 120 includes an overhanging element 123 which has a lower surface 125 that is shaped to catch the bottom edge of an iron golf club. The compartments 126 beneath the plate 10 are individual tubes in this embodiment, and each is provided with a compression spring 127 located in the bottom of the compartment. The spring 127 is formed to bear against the bottom of the shaft 128 and to be compressed by the action of inserting the shaft fully into the compartment 126.

The operation of this embodiment of the invention is as follows. When the golf club shaft is inserted into compartment 126, it contacts spring 127 and is held with some surfaces of the club head higher than surface 125. The club head is then depressed and rotated to become latched beneath overhanging element 123, and then it is released, after which it is held tightly against surface 125 by the action of spring 127. The cam-like surface 125 causes the face of club 122 to be moved snugly into contact with surface 121, whereby the club head is prevented from rattling or rotating around the axis of its shaft even if the device of this invention is turned upside down.

When the club is to be removed from the device of FIG. 7, it may be pushed down against spring 127 and rotated out from beneath overhanging element 123; or, if the upwardly extending element 120 is of flexible material, the overhanging element 123 may be bent so that surface 125 is vertical, after which spring 127 may expand to release the club.

It is evident that many other variations of the device of this invention may be made within its broad scope.

What is claimed is:

1. A device for carrying golf clubs comprising

A. a plate having an upper face,

B. a plurality of holes intersecting said upper face and passing through the plate with each hole being large enough to admit the handle of the golf club, C. said upper face including golf club receiving surfaces adjacent to at least some of said holes with said surfaces extending from the holes, with the intersections of the planes of said surfaces and the plane of said upper face being parallel and with the angles between the plane of the surfaces and the plane of the upper face corresponding to the loft angles of golf club irons, and with the width of the golf club receiving surfaces being greater than the width of the blade of the corresponding golf club irons, D. a compartment beneath said plate to enclose handles and shafts of golf clubs with said compartment being longer than the distance between the club head and the end of the handle of golf club irons, E. a frame connecting said plate to said compartment, F. carrying means connected to suspend said device with each of said surfaces beneath its adjacent hole, whereby, when said device is in normal position of use, each golf club iron is urged by gravity to a position with its face in contact with a golf club receiving surface.

2. The device of claim 1 wherein additional holes without club face receiving surfaces are provided for golf club woods.

3. The device of claim 1 wherein said compartment includes an individual tube connected with each of said holes and dimensioned to receive a golf club handle.

4. The device of claim 1 wherein said surfaces are on raised elements formed integrally with said upper face.

5. The device of claim 1 wherein said surfaces are in indentations formed in said plate through the upper face thereof.

6. The device of claim 5 wherein said indentations are intersected by grooves in the upper face of said plate with said grooves being deep enough to provide a finger hold on the head of a golf club in said indentation.

7. The device of claim 5 wherein the surfaces on the sides of each of said indentations converge downwardly, and the plane of each surface is at the same angle with the plane of the upper surface.

8. The device of claim 1 including a flexible outer cover having a storage compartment.

9. The device of claim 1 including indicia associated with each hole to indicate the golf club iron to be carried therein.

10. The device of claim 1 wherein magnets are embedded in said club head receiving surfaces.

* * * * *